US006870158B1

(12) United States Patent
Blain

(10) Patent No.: US 6,870,158 B1
(45) Date of Patent: Mar. 22, 2005

(54) MICROFABRICATED CYLINDRICAL ION TRAP

(75) Inventor: Matthew G. Blain, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 10/456,310

(22) Filed: Jun. 5, 2003

Related U.S. Application Data

(60) Provisional application No. 60/387,045, filed on Jun. 6, 2002.

(51) Int. Cl.[7] ..... H01J 49/26

(52) U.S. Cl. ..... 250/292; 250/281

(58) Field of Search ..... 250/281, 282, 250/288, 292

(56) References Cited

U.S. PATENT DOCUMENTS

| | | | | |
|---|---|---|---|---|
| 5,248,883 | A | 9/1993 | Brewer et al. | |
| 6,403,952 | B2 * | 6/2002 | Whitehouse et al. | 250/288 |
| 2003/0089846 | A1 | 5/2003 | Cooks et al. | |

OTHER PUBLICATIONS

Dehmelt, H.G., "Radiofrequency Spectroscopy of Stored Ions I: Storage," *Adv. Atom. Mol. Phys. 3*, 53 (1967).

Brewer et al., "Planar ion microtraps," *Phys. Rev. A 46(11)*, R6781 (1992).

March et al., *Practical Aspects of Ion Trap Mass Spectrometry, vol. I: Fundamentals of Ion Trap Mass Spectrometry*, CRC Press (1995).

Guan et al., "Stored waveform inverse Fourier transform (SWIFT) ion excitation in trapped–ion mass spectrometry: theory and applications," *Int. J. Mass Spec. Ion Proc. 157/158*, 5 (1996).

Badman et al., "A Miniature Cylindrical Quadrupole Ion Trap: Simulation and Experiment," *Anal. Chem. 70*, 4896 (1998).

Wells et al., "A Quadrupole Ion Trap with Cylindrical Geometry Operated in the Mass–Selective Instability Mode, "*Anal. Chem, 70*, 438 (1998).

Ouyang et al., "Characterization of a Serial Array of Miniature Cylindrical Ion Trap Mass Analyzers," *Rapid Comm. Mass. Spec. 13*, 2444 (1999).

Kornienko et al., "Electron impact ionization in a microion trap mass spectrometer," *Rev. Sci. Instru. 70(10)*, 3907 (1999).

(List continued on next page.)

*Primary Examiner*—John R. Lee
*Assistant Examiner*—Paul M. Gurzo
(74) *Attorney, Agent, or Firm*—Kevin W. Bieg

(57) ABSTRACT

A microscale cylindrical ion trap, having an inner radius of order one micron, can be fabricated using surface micromachining techniques and materials known to the integrated circuits manufacturing and microelectromechanical systems industries. Micromachining methods enable batch fabrication, reduced manufacturing costs, dimensional and positional precision, and monolithic integration of massive arrays of ion traps with microscale ion generation and detection devices. Massive arraying enables the microscale cylindrical ion trap to retain the resolution, sensitivity, and mass range advantages necessary for high chemical selectivity. The microscale CIT has a reduced ion mean free path, allowing operation at higher pressures with less expensive and less bulky vacuum pumping system, and with lower battery power than conventional- and miniature-sized ion traps. The reduced electrode voltage enables integration of the microscale cylindrical ion trap with on-chip integrated circuit-based rf operation and detection electronics (i.e., cell phone electronics). Therefore, the full performance advantages of microscale cylindrical ion traps can be realized in truly field portable, handheld microanalysis systems.

13 Claims, 12 Drawing Sheets

OTHER PUBLICATIONS

Badman et al., "A Parallel Miniature Cylindrical Ion Trap Array," *Anal. Chem. 72*, 3291 (2000).

Badman et al., "Cylindrical Ion Trap Array with Mass Selection by Variation in Trap Dimensions," *Anal. Chem. 72*, 5079 (2000).

Badman et al., "Miniature mass analyzers," *J. Mass Spec. 35*, 659 (2000).

Taylor et al., "Silicon based quadrupole mass spectrometry using microelectromechanical systems," *J. Vac. Sci. Technol. B 19*(2), 557 (2001).

Riter et al., "Analytical Performance of a Miniature Cylindrical Ion Trap Mass Spectrometer," *Anal. Chem. 74*, 6154 (2002).

Orient et al., "A compact high–resolution Paul ion trap mass spectrometer with electron–impact ionization," *Rev. Sci. Inst. 73*(5), 2157 (2002).

Patterson et al., "Miniature Cylindrical Ion Trap Mass Spectrometer," *Anal. Chem. 74*, 6145 (2002).

* cited by examiner

MICROFABRICATED CYLINDRICAL ION TRAP

CROSS-REFERENCE TO RELATED APPLICATION

This application claims the benefit of U.S. Provisional Application No. 60/387,045, filed Jun. 6, 2002.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to ion storage and analysis and, in particular, to a microscale cylindrical ion trap fabricated using surface micromachining techniques.

BACKGROUND OF THE INVENTION

A mass spectrometer (MS) is a device that filters gaseous ions according to their mass-to-charge (m/z) ratio and measures the relative abundance of each ionic species. A typical mass spectrometer comprises an ion source, wherein the ions are generated; a mass filter, wherein the ions are separated in space or in time; an ion detector, wherein the filtered ions are collected and their relative ion abundance measured; a vacuum system; and means to power the spectrometer. Depending on the type of sample and the method of introducing the sample into the mass spectrometer, ions can be generated in the ion source by electron impact ionization, photoionization, thermal ionization, chemical ionization, desorption ionization, spray ionization, or other processes. Mass spectrometers are generally classified according to the method on which mass filtering is accomplished using electric and/or magnetic fields. Mass filter types include magnetic-sector, time-of-flight, linear quadrupole, ion cyclotron resonance, and ion traps. Detection of ions is typically accomplished by a single-point ion collector, such as a Faraday cup or electronic multiplier, or a multipoint collector, such as an array or microchannel plate collector, whereby all of the ions arrive at the collector simultaneously.

Mass spectrometer performance is generally given in terms of mass range, resolution (i.e., resolving power), and sensitivity of the instrument. Mass range is the lowest and highest masses that can be measured. A large mass range is desired for the analysis of high molecular weight organic and biological analytes. Resolution measures the ability of the instrument to separate and identify ions of slightly different masses. Typically, the resolution for singly charged ions is given by $$R = \frac{m}{\Delta m} \tag{1}$$

where m is the mass of an ion peak in atomic mass units and Δm is the width of the peak at some peak height level (e.g., half peak height). In many cases, the minimum resolution required is such that a molecular ion can be resolved from an adjacent peak having a unit mass difference. According to this requirement, the resolution R should be at least 100 for a chemical species having a nominal mass of 100. High-resolution instruments, required for organic mass spectrometry, can detect peaks separated by fractions of a mass unit. Sensitivity is a measure of the instrument's response to ions of an arbitrary m/z ratio for a particular sample. Sensitivity is typically a function of the efficiency of the ion source and ion detector, as well as the analyzer method used. The sensitivity limit, or detection limit, is the minimum amount of a sample that can be detected under a given set of experimental conditions and distinguished from the instrument noise level and background. Resolution and sensitivity are approximately inversely related to each other. Other important characteristics of a spectrometer instrument include overall size, operating pressure, voltage, and power consumption.

Mass spectrometers can be used for chemical sensing. Analyzing mixtures may be difficult when the mass spectrometer is used alone, since the resulting mass spectrum would be a complex summation of the spectra of the individual components. Therefore, analytical techniques combining the separation methods of gas chromatography and mass spectrometry are often used for chemical sensing. A gas chromatograph (GC) separates volatile mixtures into their component chemical species, which are eluted from a long capillary. The eluents can then be transferred into a mass spectrometer to obtain a mass spectrum of each of the separated components, from which the molecular structure of the individual component species can be inferred. The GC/MS is therefore capable of separating highly complex mixtures, identifying the components, and quantifying their amounts. Alternatively, tandem (MS/MS) or multistage ($MS^n$) mass spectrometers can be combined, wherein one of the mass spectrometers is used to isolate individual ions according to their m/z ratio, and the other is used to examine the fragmentation products of the individual ions.

Recently, there has been a growing interest in miniature mass spectrometers. The effect of miniaturization on performance depends on the method of mass analysis. For most methods, mass range and resolution decrease with miniaturization. However, sensitivity may be improved, while power and pumping requirements may be reduced compared to conventional instruments. In particular, the smaller dimensions of miniature analyzers reduces the number of collisions that the ion makes with background gases due to the reduced distance of travel. Therefore, operating pressure requirements may be relaxed with miniaturization. See E. R. Badman and R. G. Cooks, "Miniature mass analyzers," *J. Mass Spectrometry* 35, 659 (2000).

Magnetic-sector instruments deflect ions, traveling at constant velocity in a perpendicular magnetic field, along a curved path thereby dispersing them in space according to their m/z values. Alternatively, the magnetic field of the sector can be scanned to sweep the ions across a point detector. Sector mass spectrometers can have high resolution and high mass accuracy, even for high-energy analysis. However, quite large magnetic fields, on the order of tens of Tesla, are required to maintain resolution and detectable mass range as the size of the sector is reduced. Therefore, magnetic-sector instruments are not well-suited to miniaturization.

In a time-of-flight (TOF) mass spectrometer, ions are accelerated to approximately constant kinetic energy in a pulse and allowed to drift down a long flight tube. The TOF mass spectrometer thereby enables temporal discrimination of ions according to their flight time, which is determined by their m/z ratio. Conventional TOF mass spectrometers typically have a high mass range, short analysis time, and are relatively low cost. However, for miniaturized TOF mass spectrometers, the accelerating voltage must be decreased to maintain mass range as the drift length is reduced, seriously degrading resolution.

Linear quadruple mass spectrometers (QMS) filter ions by passing them through tuned radiofrequency (rf) and direct current (dc) electrical fields defined by four, symmetrically parallel quadrupole rods. The QMS permits only those ions with a stable trajectory, determined by their m/z ratio, to travel along the entire length of the central axis of the rod assembly without being deflected out of the intra-rod space. Ions with different m/z ratios can be scanned through the QMS by continuously varying the field between the quadrupole rods. Therefore, the QMS is a variable bandpass filtering ion optic. Miniature linear quadrupoles require lower drive voltages and higher rf drive frequencies to filter heavier ions and maintain resolution as the electrode dimensions decrease. The relative dimensional and positional precision of the parts must be maintained as their size is reduced, although the rod length remains large, relative to the aperture, to provide adequate filtering. However, the QMS is relatively pressure intolerant and can operate effectively at relatively high pressures (e.g., $10^{-4}$ Torr). Therefore, they are more amenable to miniaturization due to the avoidance of bulky vacuum pumping systems.

A three-dimensional analogue of the linear QMS is the quadrupole ion trap (QIT). Like the linear quadrupole, the QIT can control the stability of ion motion in an electric field and can therefore be used for mass analysis. The QIT comprises a central, donut-shaped hyberboloid ring electrode and two hyperbolic endcap electrodes. In normal usage, the endcaps are held at ground potential, and the rf oscillating drive voltage is applied to the ring electrode. Ion trapping occurs due to the formation of a trapping potential well in the central intraelectrode region when appropriate time-dependent voltages are applied to the electrodes. The ions orbit in the trap and are stabilized or destabilized as the trapping conditions are changed. With mass-selective ejection of ions, the ions become unstable in the Z-direction of the well and are ejected from the trap in order of ascending m/z ratio as the rf voltage applied to the ring is ramped. The ejected ions can be detected by an external detector, such as an electron multiplier, after passing through an aperture in one of the endcap electrodes. Like the QMS, ion traps have the advantage of being able to operate at higher pressures. Indeed, a background pressure of a light buffer gas (e.g., $10^{-3}$ Torr of helium) is often used to collisionally "cool" the kinetic energy of the trapped ions to achieve coherence, thereby improving the mass resolution and sensitivity of the analyzed ions.

Unlike most other methods of mass analysis, a decrease in the dimensions of the QIT allows trapping of higher m/z ratio ions for fixed operating parameters. Alternatively, for a given m/z ratio, the voltage required to eject ions is reduced quadratically with the linear trap dimension, enabling lower voltages to be used to analyze the same mass range. Like the linear quadrupole, the drive frequency of the QIT must be increased to maintain resolution as the spectrometer dimensions are decreased. The major problem with the miniature ion trap is that the ion storage capacity of the trap decreases with size, reducing the dynamic range and sensitivity.

A cylindrical ion trap (CIT), comprising planar endcap electrodes and a cylindrical ring electrode, rather than hyperbolic electrode surfaces, produces a field that is approximately quadrupolar near the center of the trap. Therefore, CITs have been found to provide performance comparable to QITs. Moreover, the CIT is favored for miniature ion storage and mass analysis devices, because CITs are relatively simple and can be easily machined. Arrays of miniature CITs, with trap dimensions on the order of a millimeter, have been manufactured using precision machining to regain a portion of the lost storage capacity and thereby improving sensitivity. See U.S. patent application Ser. No. 20030089846 to Cooks et al., which is incorporated herein by reference.

The inner radius ro of the trapping ring electrode determines the m/z ratio of the trapped ions. Therefore, variable $r_0$ parallel arrays of miniature CITs, each individual trap having a proportionately different size, can be configured to simultaneously trap and monitor different-sized ions. A low-resolution spectra of a multiple ion sample can be obtained from such a variable $r_0$ parallel array by simultaneously ejecting the trapped ions with a dc pulse, without the need to scan the applied rf voltage. The ejected ions can be detected with a position-sensitive detector, resulting in a reduced power requirement and simplification of the ion trap control electronics. See Badman et al., "Cylindrical Ion Trap Array with Mass Selection by Variation in Trap Dimensions," *Anal. Chem.* 72(20), 5079 (2000).

Alternatively, the use of multiple traps in a single $r_0$ parallel array can offset some of the loss in ion storage capacity with miniaturization. In the standard mass-ejection analysis mode, parallel arrays of miniature CITs having the same trap dimensions can be scanned to provide simultaneous ejection of similar ions from all traps, providing improved sensitivity. See Badman et al., "A Parallel Miniature Cylindrical Ion Trap Array," *Anal. Chem.* 72(14), 3291 (2000).

Serial arrays of such miniature CITs can be also be used for ion storage, mass selection, and ion reaction and product ion analysis. For example, serial arrays of miniature CITs, wherein ions trapped in a first CIT are transferred to a second CIT, can be used to provide multiple stages of mass isolation and analysis in a tandem MS/MS or multistage $MS^n$ capability. See Z. Ouyang et al., "Characterization of a Serial Array of Miniature Cylindrical Ion Trap Mass Analyzers," *Rapid Comm. Mass Spect.* 13, 2444 (1999).

However, precision machining methods only provide arrays of miniature CITs comprising a few millimeter-sized traps. Furthermore, bulk micromachining techniques, whereby holes are etched in a semiconductor body or wafer, provide traps with trap dimensions comparable to the wafer thickness (i.e., hundreds of microns). These relatively large traps are not well suited for truly field portable, handheld microanalytical systems. Such microanalytical systems, which have been termed "chemical laboratories on a chip," are being developed to enable the rapid and sensitive detection of particular chemicals, including pollutants, high explosives, and chemical warfare agents. These microanalytical systems should provide a high degree of chemical selectivity to discriminate against potential background interferents, be able to perform the chemical analysis on a short time scale, and consume low amounts of electrical power for prolonged field use.

The present invention is directed to a microscale cylindrical ion trap. The microscale CIT is approximately three orders of magnitude smaller in trap dimensions than the miniature CIT of Cooks et al. The microscale CIT can be fabricated using surface micromachining techniques and materials known to the integrated circuits (IC) manufacturing and microelectromechanical systems (MEMS) industries. Such methods enable batch fabrication, reduced manufacturing costs, dimensional and positional precision, and monolithic integration of massive arrays of ion traps with microscale ion generation and detection devices. Massive arraying enables the: microscale CIT to retain the mass range, resolution, and sensitivity advantages necessary for high chemical selectivity. Furthermore, a microfabricated massively parallel CIT array can be integrated with a microfabricated gas chromatography column for the analysis of complex mixtures, or stacked in serial arrays to provide a tandem or multistage mass isolation and analysis capability. The reduced dimension of the microscale CIT allows for a reduced ion mean free path (MFP), resulting in higher operating pressures (e.g., on the order of a Torr, rather than a milliTorr) with a less expensive and less bulky vacuum pumping system, and with lower battery power. The reduced electrode voltage (e.g., 1–10 volts, rather than kilovolts) enables integration of the microscale CIT with on-chip integrated circuit-based rf operation and detection electronics (i.e., cell phone electronics). Therefore, the full performance advantages of microscale CITs can be realized in truly field portable, handheld microanalysis systems.

SUMMARY OF THE INVENTION

The present invention is directed to a microfabricated cylindrical ion trap, comprising an ion collector substrate; a collector dielectric layer on the ion collector substrate; an extraction endcap electrode layer on the collector dielectric layer; an extraction endcap dielectric layer on the extraction endcap electrode layer; a ring electrode layer, having at least one cylindrical hole formed therein to trap ions, on the extraction endcap dielectric layer; an injection endcap dielectric layer on the ring electrode layer; an injection endcap electrode layer on the injection endcap dielectric layer; and means for applying an radiofrequency drive voltage between the ring electrode layer and the endcap electrode layers; and wherein the injection endcap layer has at least one injection aperture formed therethrough for injection of a sample gas into the at least one cylindrical hole; and wherein the extraction endcap layer has at least one extraction aperture formed therethrough for ejection of the ions from the at least one cylindrical hole and collection of the ejected ions by the ion collector layer. Alternatively, the a conducting substrate can itself provide one of the endcap electrodes. The at least one cylindrical hole can have an inner radius of less than about ten microns and, preferably, less than about one micron. The substrate can be silicon, the dielectric layers can be silicon dioxide or nitride, and the electrodes can be a metal.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

DETAILED DESCRIPTION OF THE INVENTION

The present invention comprises a microfabricated cylindrical ion trap, with trap dimensions of order one micrometer (i.e., generally from about ten microns to sub-micron in linear dimension). The microfabricated CIT can be used both for mass analysis and to store ions (e.g., as in quantum computing applications, atomic/molecular physics experiments, etc.). When used as a mass spectrometer, the microfabricated CIT can have a high resolution and mass range. A massively parallel array of such CITs can provide greater than $10^6$ individual mass analyzers in a one $cm^2$ area for high sensitivity. The microfabricated CIT provides a simple geometry that can be fabricated using surface micromachining techniques and integrated on-chip with an ion source, ion detector, and the control circuitry. In particular, solid-state signal preamplifiers and rf drive electronics can be fabricated in silicon with the CITs built into the back-end metallization of the device electronics. Vacuum and power requirements scale with the device dimensions.

Figure 1:
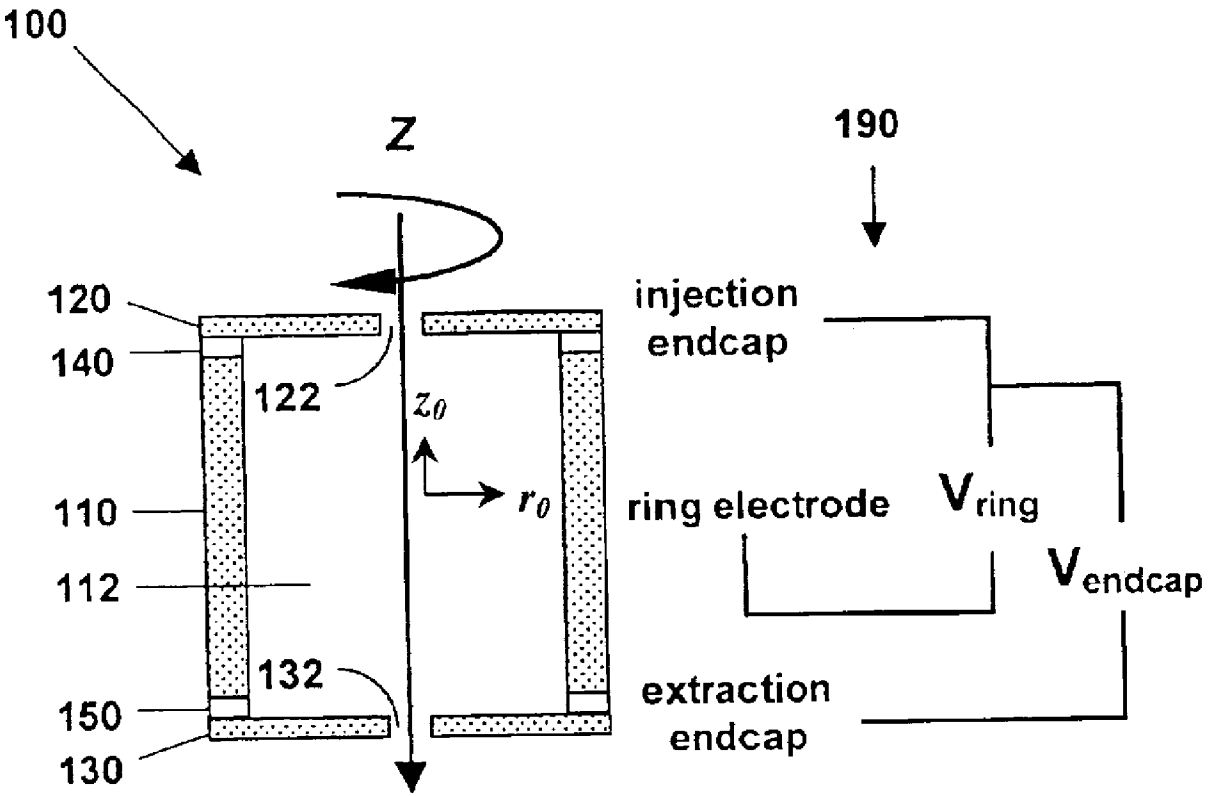
FIG. 1 shows a schematic illustration of a single cylindrical ion trap.

In FIG. 1 is shown a schematic illustration of a single CIT 100 comprising a cylindrical ring electrode 110, two planar endcap electrodes 120 and 130, and endcap dielectric spacers 140 and 150 between the ring electrode 110 and the endcap electrodes 120 and 130. Ions are trapped in the trapping volume 112 defined by the cylindrical ring electrode 110 and the endcap electrodes 120 and 130. Apertures 122 and 132 can be provided in the endcap electrodes 120 and 130 for injection of a neutral or ionized sample gas into and ejection of the ions from the trapping volume 112. The CIT is rotationally symmetric about the cylindrical Z axis. $r_0$ is the inner radius of the ring electrode 110 and $z_0$ is the center-to-endcap distance. The CIT can be energized by a power source 190 that provides a dc or rf voltage $V_{endcap}$ between the two endcap electrodes 120 and 130 and a rf drive voltage $V_{ring}$ between the ring electrode 110 and the endcap electrodes for trapping of the ions. Direct current signals can also be applied to the ring electrode 110 for additional isolation of ions having a particular mass-to-charge ratio.

The voltage and frequency of a microscale CIT can be chosen using the same criteria as a conventional QIT: 1) the ion motion in the trap must be stable in both the r and z directions, and 2) the potential well must be large enough, compared to the initial energy of the ion, to trap it. Because of these criteria, the voltage cannot be chosen arbitrarily small. The rf frequency must be increased accordingly.

The ion motion in the trap must be stable. Ion trapping in the trapping volume arises from a quadrupolar potential well when appropriate voltages are applied to the electrodes. Ion motion in a quadrupole field can be described by solutions to the second order differential equations due to Mathieu. The solutions to the Mathieu equations define boundaries of stable and unstable regions in an $a_z$–$q_z$ space of the Mathieu stability diagram. $a_z$ and $q_z$ are known as the Mathieu trapping parameters. See R. E. March et al., *Practical Aspects of Ion Trap Mass Spectrometry, Vol. I: Fundamentals of Ion Trap Mass Spectrometry*, CRC Press (1995).

The mass analysis equation for the QIT, derived from the stable solutions to the Mathieu equation, is $$\frac{m}{z} = \frac{8V_{rf}}{q_z\Omega^2(r_0^2 + 2z_0^2)} \tag{1}$$

where $V_{rf}$ is the zero-to-peak voltage of the applied rf trapping potential, $q_z$ is the Mathieu parameter when the ion is ejected from the trap in the Z direction (generally less than 0.908), $\Omega$ is the angular rf drive frequency, $r_0$ is the inner radius of the hyperboloid ring electrode, and $z_0$ is the center-to-endcap distance. For a perfectly quadrupolar field, the electrodes are arranged according to $r_0^2=2z_0^2$. Similar solutions to the Mathieu equations are possible for the near-quadrupolar fields of the CIT using a pseudopotential approximation. In particular, optimum trapping conditions for the CIT often occur for a "stretched" trap geometry (e.g., $r_0^2=1.7z_0^2$).

The mass analysis equation, eq. (1), indicates that, for fixed operating parameters, a decrease in the dimensions of the ion trap (i.e., $r_0$ and $z_0$) causes ions of higher m/z ratio to be trapped. Alternatively, for a given m/z ratio, the voltage required to eject ions is reduced quadratically or the rf drive frequency is increased linearly with the linear trap dimension. Therefore, lower voltages and/or higher frequencies can be used to analyze the same mass range.

Figure 2:
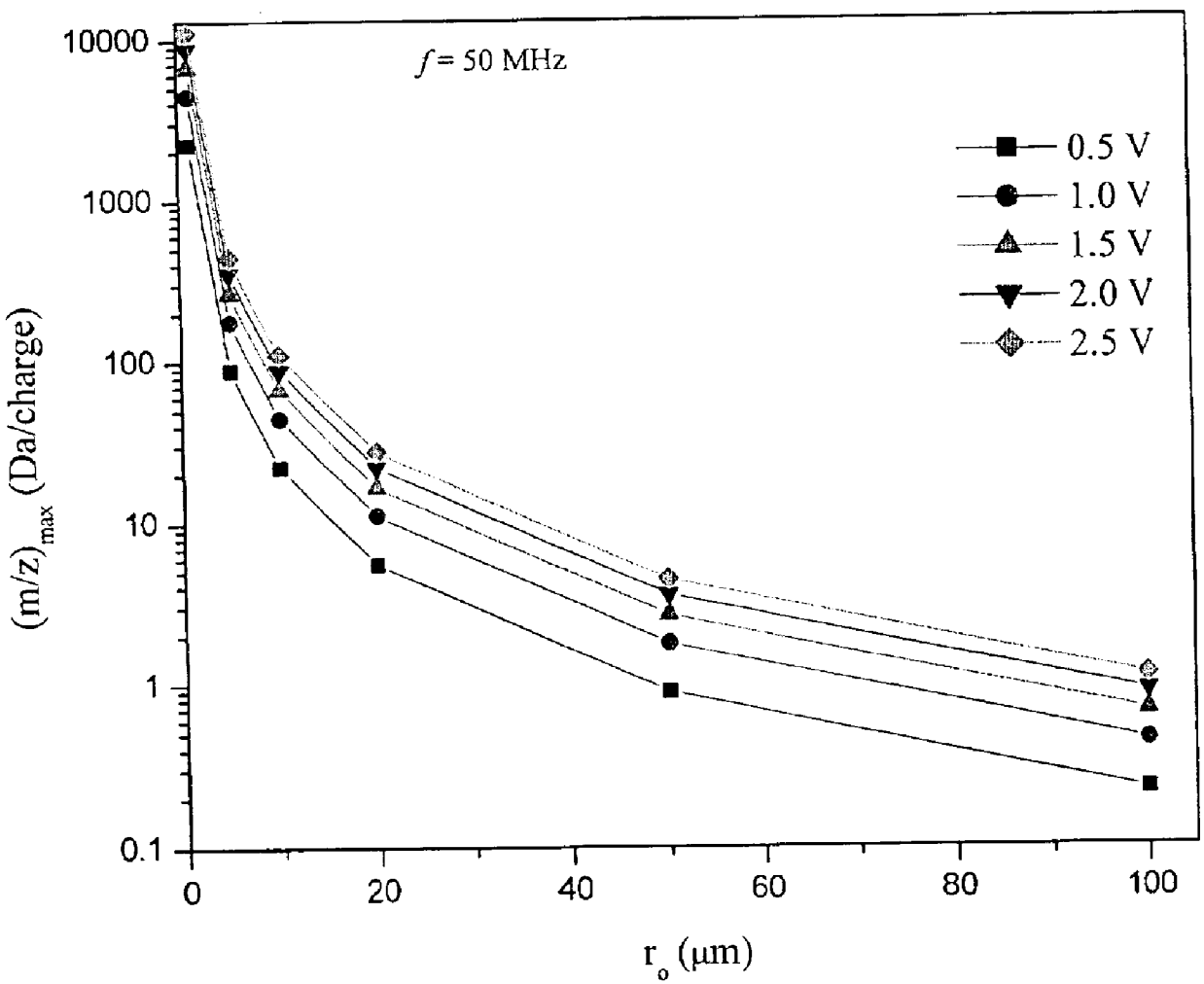
FIG. 2 shows plots of the maximum mass-to-charge ratio as a function of trap radius for various trapping voltages at a fixed frequency of 50 MHz.

In FIG. 2 are shown plots of the maximum m/z ratio that can be detected as a function of the trap radius for trapping voltages of 0.5 to 2.5 volts at a fixed frequency of 50 MHz, calculated from eq. (1). Scaling down the size of the trap enables detection of higher m/z ions. With micron-size trap dimensions, molecular ions with m/z on the order of $10^4$ Da/charge and greater can be detected (a Dalton, abbreviated Da, is the molecular weight of the analyte). With larger traps, only very small masses could be detected at this frequency and at these low voltages.

Figure 3:
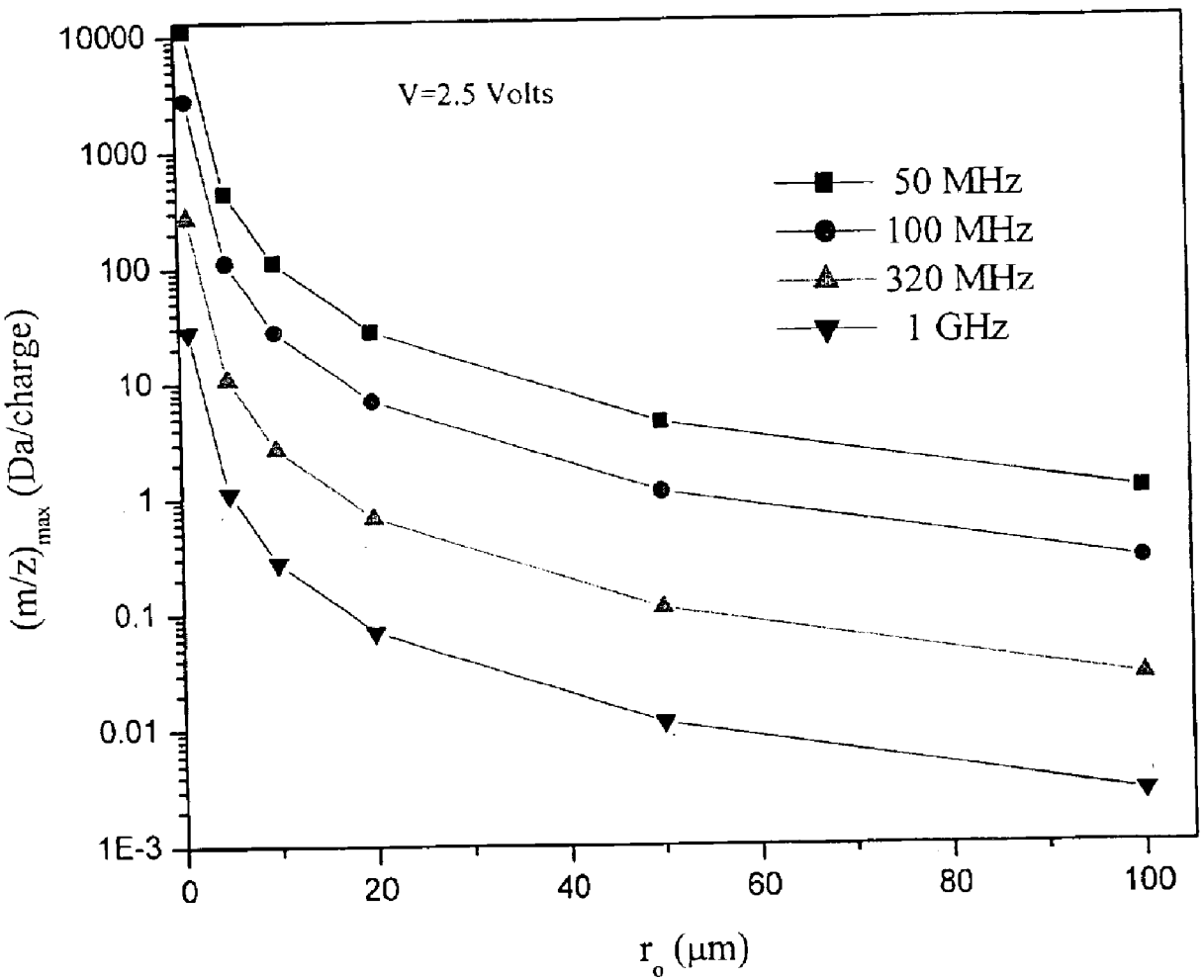
FIG. 3 shows plots of the maximum mass-to-charge ratio as a function of trap radius for various drive frequencies at a fixed voltage of 2.5 volts.

The drive frequency of the trapping voltage must be increased to detect low mass ions and maintain resolution as the trap dimensions are decreased. In FIG. 3 are shown plots of the calculated maximum m/z ratio as a function of the trap radius for drive frequencies of 50 MHz to 1 GHz at a fixed voltage of 2.5 volts. Drive frequencies greater than about 50 MHz are required with micron-sized traps to maintain adequate sensitivity in the low mass range of $10^2$–$10^3$ Da.

Figure 4:
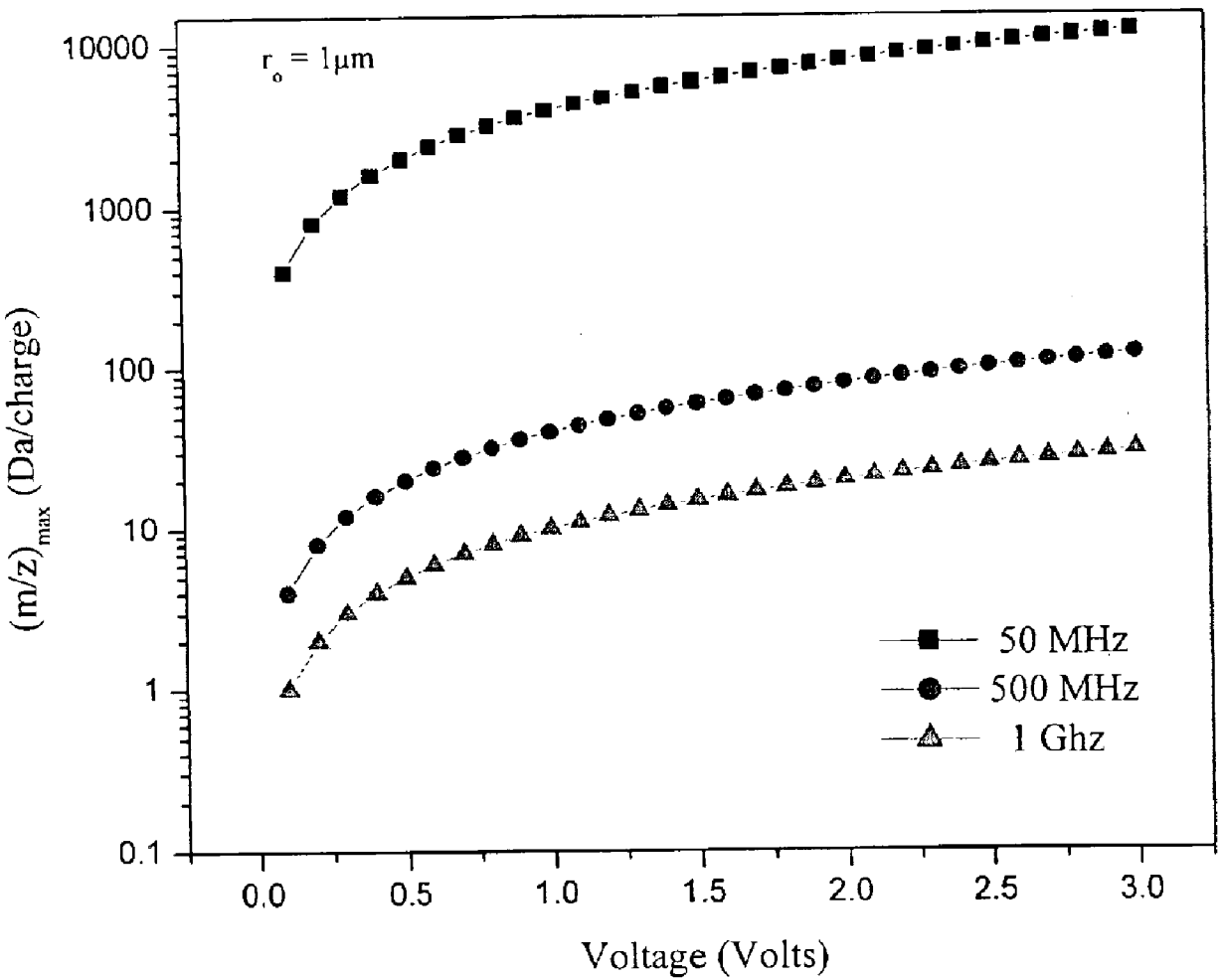
FIG. 4 shows plots of the maximum mass-to-charge ratio as a function of trapping voltage for various drive frequencies for an ion trap having an inner radius of one micron.
Figure 5:
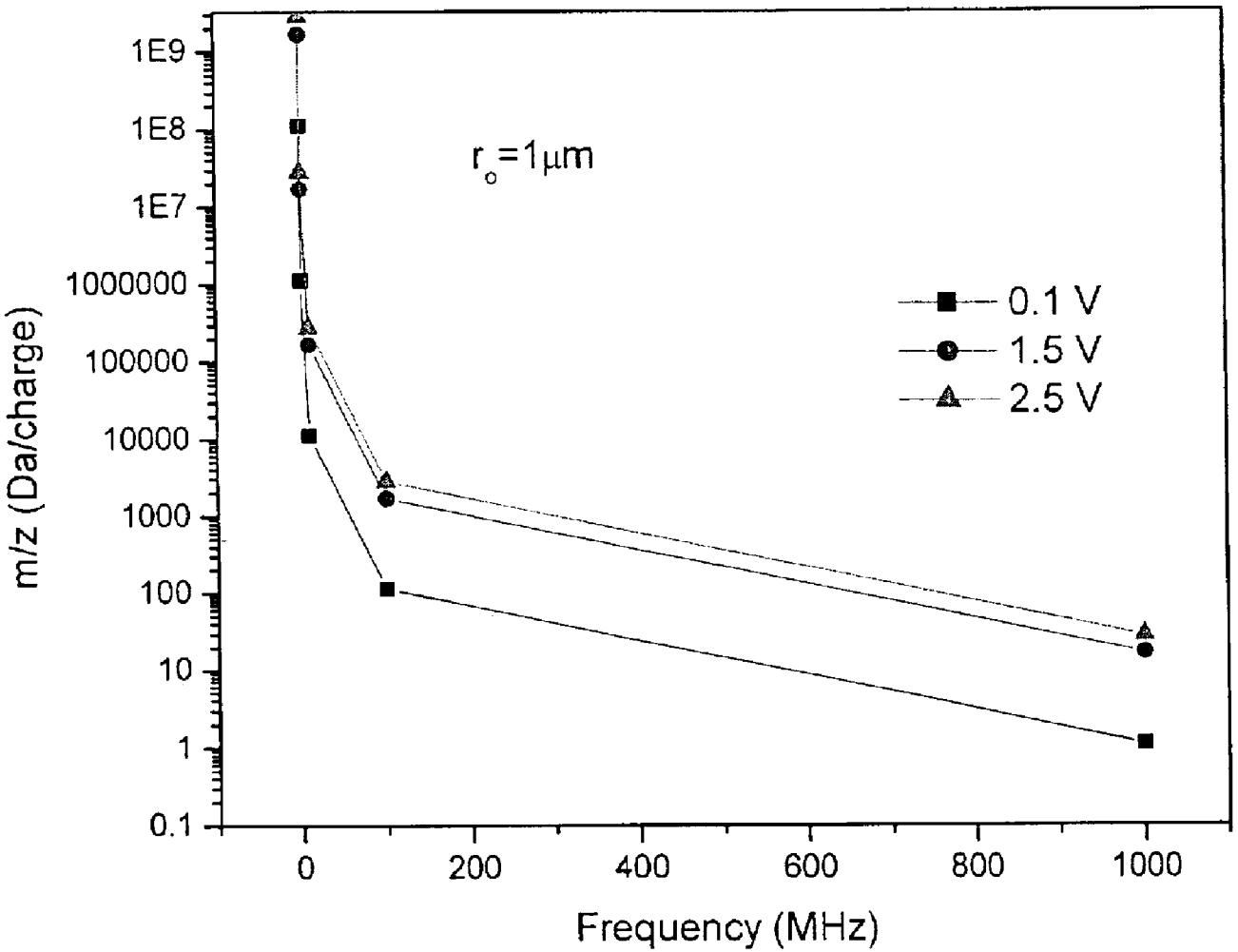
FIG. 5 shows plots of the maximum mass-to-charge ratio as a function of drive frequency for various trapping voltages for an ion trap having an inner radius of one micron.

In FIGS. 4 and 5 are shown the calculated maximum m/z ratio that can be achieved with a QIT, having an inner radius of $r_0$=1 $\mu$m and a center-to-endcap distance of $z_0$=0.707 $\mu$m, for various drive frequencies and operating voltages. Microscale ion traps require high-frequency, low-voltage operation. For an m/z ratio of $10^2$–$10^4$ Da/charge, a drive frequency of 50–100 MHz and a voltage of 0.1–2.5 volts are preferred, however the thermal energies of the trapped ions will limit the lowest useable voltage.

In addition to operation at a working point in the stability region, the potential well must be deep enough, compared to the initial thermal energy of the ion, to trap it. Therefore, the trapping voltage can not be chosen arbitrarily small. The potential well depth $D_z$ for the ideal quadrupole geometry is given by $$D_z = \frac{q_z V_{rf}}{8} \tag{2}$$

See Dehmelt, H. G., "Radiofrequency Spectroscopy of Stored Ions I: Storage," *Adv. Atom. Mol. Phys.* 3, 53 (1967). Dehmelt has derived a pseudopotential approximate solution for the well depth for near-quadrupolar fields:

$$D_z = \frac{q_z V_{eff}}{8} \tag{3}$$

where $V_{eff}$ is an effective potential. For a CIT with $r_0=2z_0$ and a ring voltage of $V_{ring}$, the effective potential is $V_{eff}$= 0.55 $V_{ring}$. For the CIT to trap an ion, the well depth $D_z$ is preferably at least three times greater than the thermal energy. Therefore $D_z>D_{min}$=3 kT=0.0762 at room temperature. Accordingly, for effective trapping of thermal ions by the CIT, $$q_{z,min}V_{ring,min} \geq 1.108 \tag{4}$$

Figure 6:
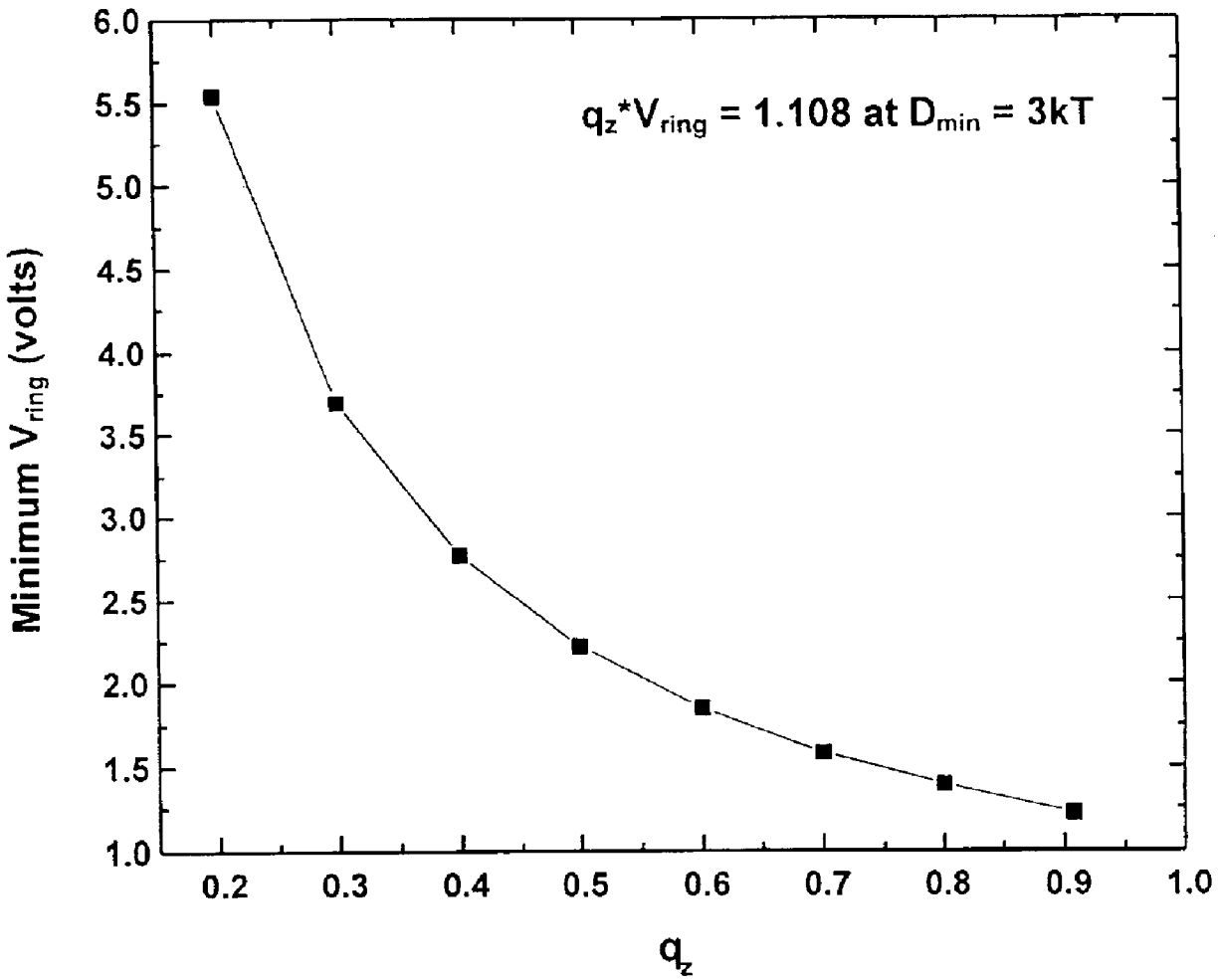
FIG. 6 shows the minimum ring electrode voltage as a function of the Mathieu stability parameter $q_z$ at pseudopotential well depth of 3 kT.

In FIG. 6 is shown the minimum ring electrode voltage $V_{ring,min}$ as a function of the Mathieu stability parameter $q_{z,min}$ at $D_{min}$=3 kT, according to eq. (4). The minimum operating voltage varies inversely with $q_{z,min}$ for ion ejection to be dominated by the induced rf potentials rather than thermal properties of the ions. In particular, the ring voltage $V_{ring}$ of the CIT must be greater than 1.22 volts to trap a thermal ion at the limit of the Mathieu stability region (i.e., at $q_z$=0.908)

The mass range of the CIT can be determined by comparing the lowest mass ions that can be stably trapped at the minimum ring electrode voltage, to the highest mass ions that can be trapped at the maximum ring electrode voltage, as limited by the well depth. With mass-selective scanning, one selects a minimum ring electrode voltage (i.e., $V_{ring,min}$>1.22 volts) to start a scan. The selected minimum operating voltage determines the minimum Mathieu stability parameter $q_{z,min}$, according to eq. (4). Therefore, ions corresponding to $q_{z,min}<q_z<0.908$ will have stable motions and will be trapped at this minimum voltage. The m/z ratio of the lowest mass ions that are trapped (i.e., those at the edge of the stable region of the Mathieu stability diagram) can be determined by substituting $V_{rf}=V_{ring,min}$ and $q_z$=0.908 into eq. (1) for fixed rf drive frequency and trap dimensions. The stability requirement therefore establishes a Low Mass Cut-Off (LMCO). Ions with masses less than the LMCO will have unstable orbits and will not be trapped. The m/z ratio of the highest mass ions that are trapped can be determined by substituting $V_{rf}=V_{ring,min}$ and $q_z=q_{z,min}$ into eq. (1). The existence of the pseudopotential well-depth limit $D_{min}$ therefore defines a Well-depth Limited Mass Limit (WLML) that is a high-mass analogue of the LMCO. Ions with masses greater than the WLML will escape the trap due to their thermal energy. The maximum ring voltage $V_{ring,max}$ at which the highest mass ions are ejected from the trap can be determined by substituting the m/z ratio of the highest mass ions and $q_z$=0.908 into eq. (1). Starting at $V_{ring,min}$, the lowest mass ions are ejected first. As the rf voltage applied to the ring electrode is ramped, ions of ascending m/z ratio become unstable in the Z-direction until the highest mass ions are finally ejected at $V_{ring,max}$.

Figure 7:
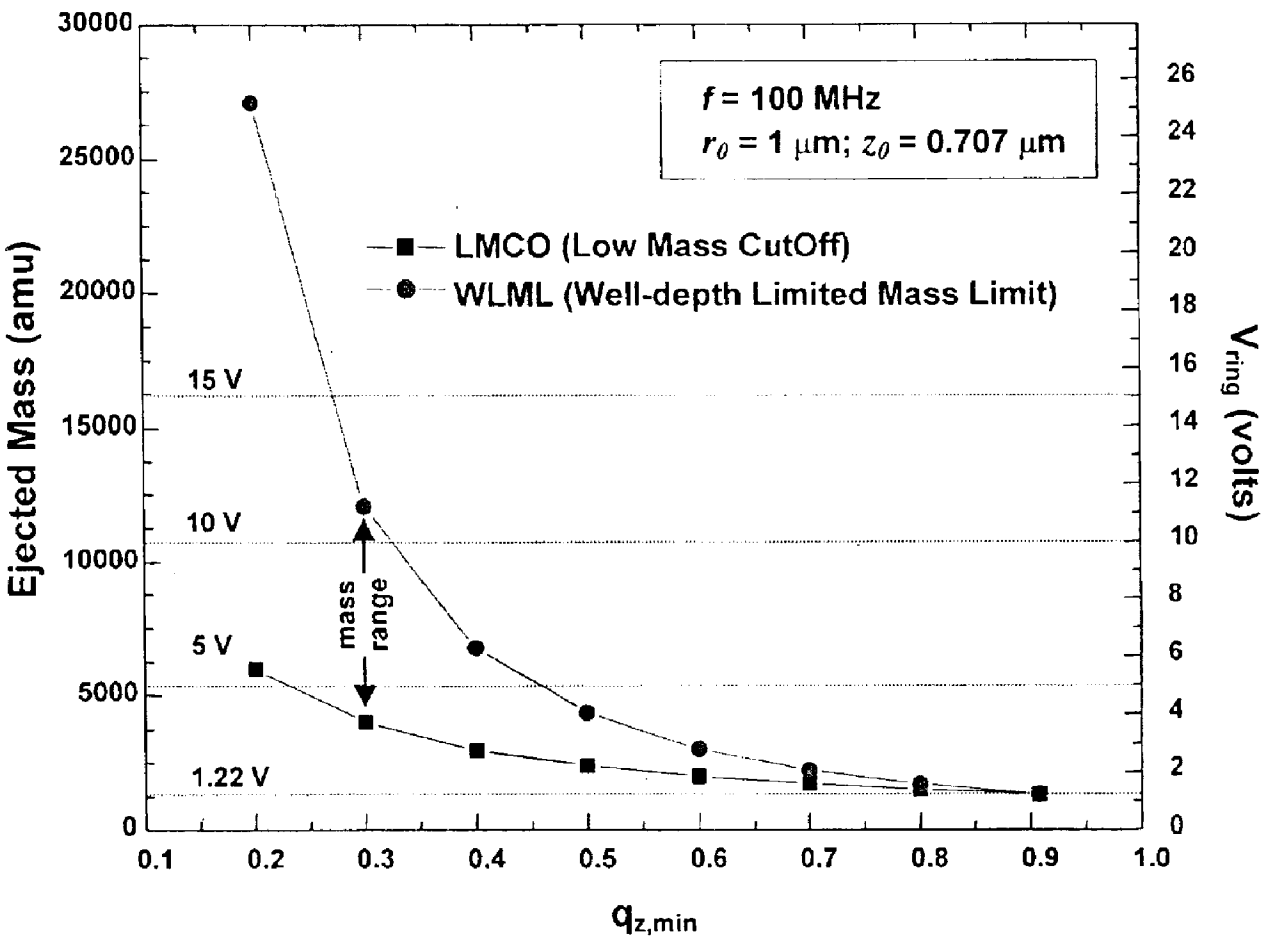
FIG. 7 shows the mass range for an ion trap having an inner radius of one micron operating at a drive frequency of 100 MHz.

In FIG. 7 is shown the WLML and LMCO for a microscale CIT, having an inner radius of $r_0$=1 $\mu$m and a center-to-endcap distance of $z_0$=0.707 $\mu$m, operated at a fixed rf drive frequency of 100 MHz. If a minimum ring electrode voltage of $V_{ring,min}$=3.7 volts is selected to start the scan, then $q_{z,min}$=0.3, according to eq. (4). The LMCO is about 4150 amu, using eq. (1) with $V_{ring,min}$=3.7 volts and $q_z$=0.908. The WLML is about 12,500 amu, using eq. (1) with $V_{ring,min}$=3.7 volts and $q_{z,min}$=0.3. The highest mass ions are ejected at a ring electrode voltage of $V_{ring,max}$=11.2 volts.

The mass resolution of the CIT is dictated by the precision of the rf drive potential. To obtain a unit mass resolution at 12,500 Da requires a voltage resolution of about 1 mV at a rf trapping voltage of 11.2 volts.

Figure 8:
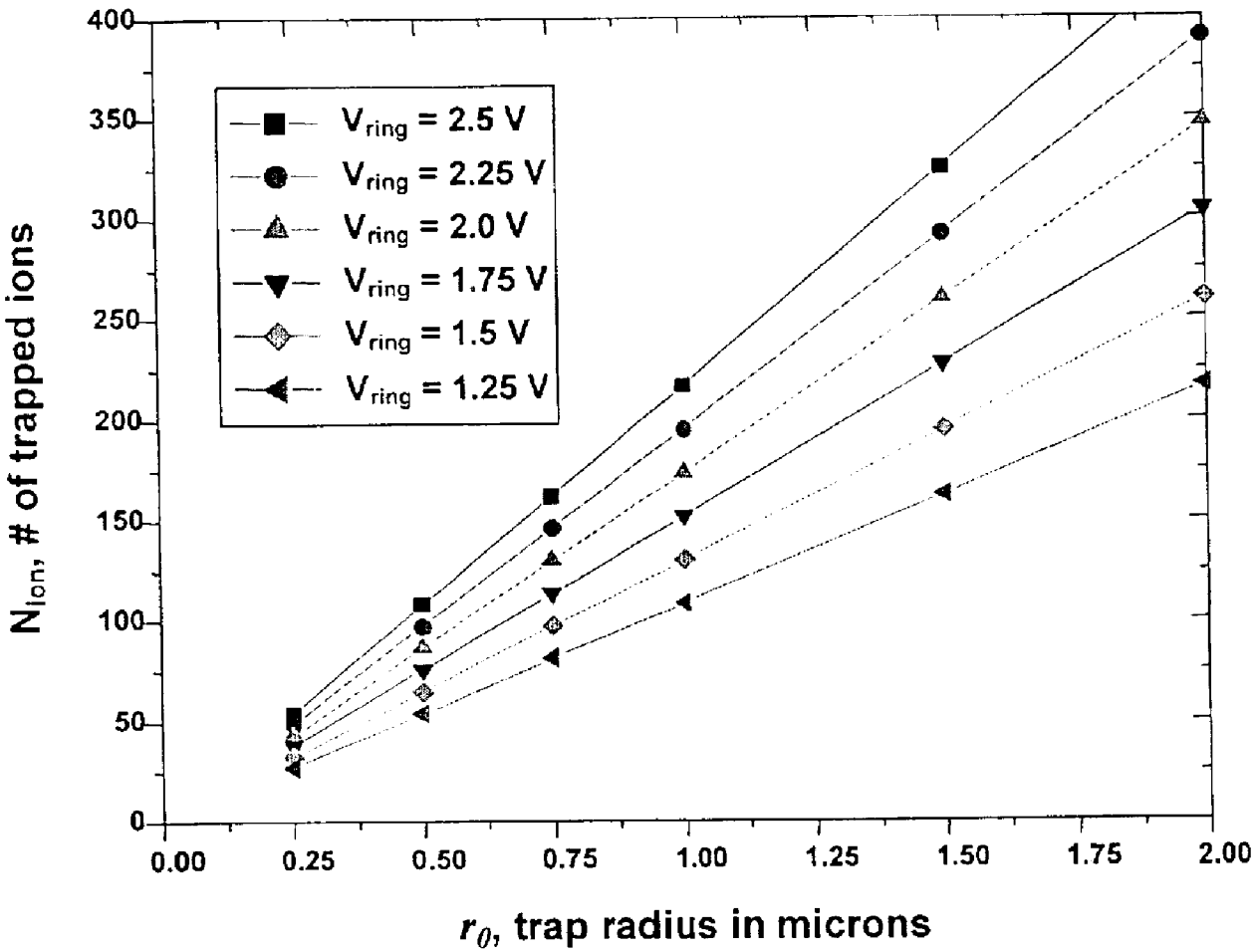
FIG. 8 shows plots of the ion storage capacity of an ion trap as a function of trap radius for different ring voltages.

The sensitivity is related to the ion storage capacity of the CIT. According to Dehmelt, the maximum ion charge stored per trap in the CIT is $$N_{ion}=(4\pi\epsilon_0)4D_z z_0/e=86.7V_{ring}r_0 \text{ ions/trap} \quad (5)$$

where $V_{ring}$ is in volts and $r_0$ is in microns. As with the QIT, ion storage capacity of the CIT decreases with size. For a conventional CIT with $V_{ring}$=7340 volts and $r_0$=1 cm, the maximum number of trapped ions is about $N_{ion}$~$6.36\times10^9$ ions/trap. See R. E. March, "Quadrupole Ion Trap Mass Spectrometry," *Encyclopedia of Analytical Chemistry,* 2000. For a miniature CIT with $V_{ring}$=195 volts and $r_0$=0.5 mm, the ion storage capacity is about $N_{ion}$~$8.5\times10^6$ ions/trap. See Kornienko et al., *Rapid Comm. Mass. Spectrom.* 13, 50 (1999). In FIG. 8 is shown a graph of the ion storage capacity $N_{ion}$ of a microscale CIT as a function of trap radius $r_0$ for different ring voltages $V_{ring}$. For the microscale CIT of the present invention with $V_{ring}$=2.5 volts and $r_0$=1 $\mu$m, the maximum stored ion charge is only about $N_{ion}$~212 ions/trap. Therefore, the detection of ions ejected from a single microscale trap would be difficult. Furthermore, when an ion trap is used for chemical analysis, the number of stored ions used to generate a mass spectrum is typically a few orders of magnitude less than the maximum ion storage capacity of the trap. For the microscale CIT, this can further reduce the number of stored ions to only a few ions per trap.

One method to regain storage capacity and increase sensitivity is to use a parallel array of microscale traps. Ions can be stored under the same conditions in multiple, identical ion traps with the same $r_0$ arranged in a parallel array and then scanned out simultaneously to a single detector. For a hexagonal close packed (HCP) arrangement of CITs with a separation of s and trap radius of $r_0$, the areal density of traps is $$N_{trap}=\frac{1.155\times10^8}{(4r_0^2+4sr_0+s^2)} \text{ traps/cm}^2 \quad (6)$$

Using eq. (5), the ion storage capacity of the HCP array of CITs is $$N_{array}=\frac{10^8 V_{ring}r_0}{(4r_0^2+4sr_0+s^2)} \text{ ions/cm}^2 \quad (7)$$

Therefore, for a HCP array with $r_0$=1 $\mu$m, s=0.5 $\mu$m, and $V_{ring}$=2.5 volts, the areal density of traps is $N_{trap}$=$1.8\times10^7$ traps/cm$^2$ and the ion storage capacity for the array of traps is $N_{array}$=$4\times10^9$ ions/cm$^2$, of the same order as the conventional CIT with $r_0$=1 cm. This ion density makes detection of particular ion fragments feasible with a simple Faraday collector plate. Preferably, the number of ions at a given mass to be greater than about $10^3$–$10^4$ for detection by such ion collector plates.

The reduced dimensions of the microscale CIT allows for a reduced ion mean free path, resulting in higher operating pressures as compared to larger ion traps. For a trap with $r_0$=1 $\mu$m, a MFP greater than or equal to the trap diameter occurs at a pressure below 440 milliTorr. The small number of stored ions and the reduced MFP of the microscale CIT may eliminate the need to collisionally cool the trapped ion(s).

Figure 9:
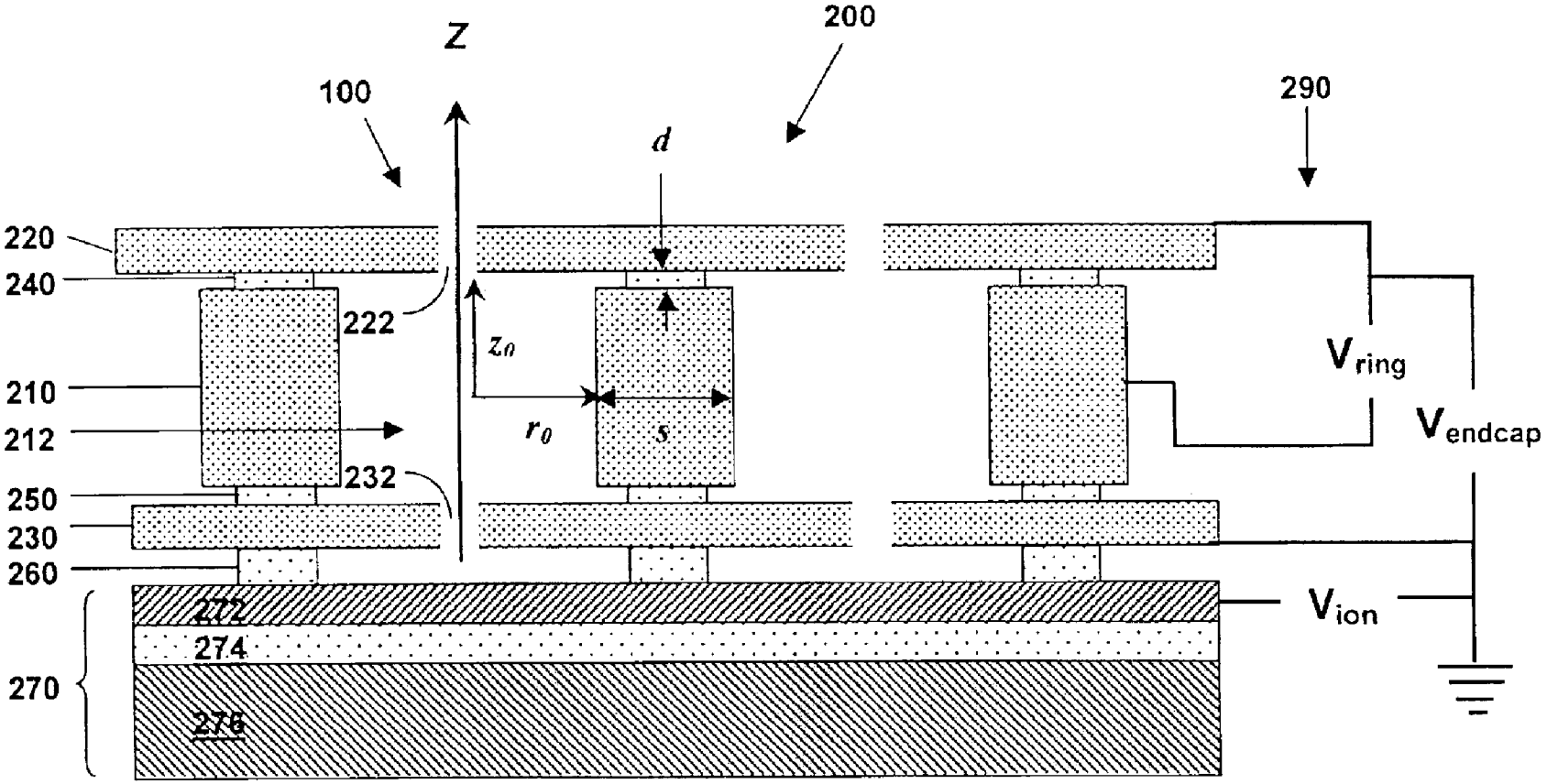
FIG. 9 shows a cross-sectional view of microfabricated array of cylindrical ion traps.

In FIG. 9 is shown a cross-sectional view of a preferred embodiment of the present invention for mass analysis, comprising a microfabricated array 200 of one or more cylindrical ion traps 100 and a Faraday-type ion collector. The CIT array 200 comprises an ion collector substrate 270, a collector dielectric layer 260, an extraction endcap electrode layer 230, an extraction endcap dielectric layer 250, a ring electrode layer 210 comprising an array of cylindrical holes 212, an injection endcap dielectric layer 240, and an injection endcap electrode layer 220. The cylindrical holes 212, along with the endcap electrode layers 220 and 230, define the trapping volume for each CIT 100. Preferably, the ring electrode layer 210 comprises an HCP array of cylindrical holes 212. Ions or ionizing radiation can be injected into the trapping volume of each CIT 100 of the array 200 through an array of injection apertures 222 in the injection endcap electrode layer 220. Each injection aperture 222 is preferably on or near the cylindrical axis of each CIT 100. The injection endcap dielectric layer 240 provides a space that electrically isolates the injection endcap electrode layer 220 from the ring electrode layer 210. Ions can be ejected from each CIT 100 of the array 200 through an array of extraction apertures 232 in the extraction endcap electrode layer 230. Each extraction aperture 232 is preferably on or near the cylindrical axis of each CIT 100. The extraction endcap dielectric layer 250 electrically isolates the ring electrode layer 210 from the extraction endcap electrode layer 230. The collector dielectric layer 260 electrically isolates the extraction endcap electrode layer 230 from the ion collector substrate 270. The electrode material of the ring electrode layer 210 and endcap electrode layers 220 and 230 is preferably a metal that is a good electrical conductor with a small rf skin depth. The dielectric layers 240, 250, and 260 are preferably a good electrical insulator. The ion collector substrate 270 can be a conducting substrate. Preferably, the ion collector substrate 270 comprises a thin conducting ion collector layer 272 on an insulating substrate. More preferably, the insulating substrate comprises a dielectric isolation layer 274 on a substrate 276 (as shown). The substrate 276 provides a mechanical support for the ion trap and is preferably a high quality wafer. A voltage $V_{ion}$ can be applied to the ion collector layer 272 to collect the ion current that is ejected from the array of traps 100 through the extraction apertures 232.

Figure 10A:
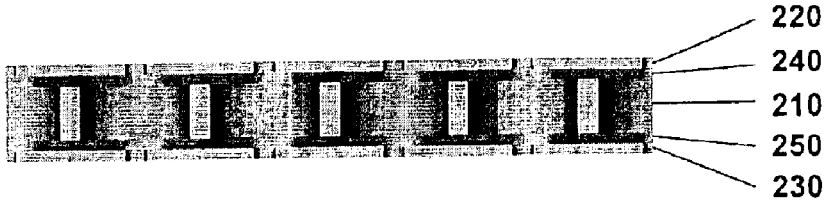
FIGS. 10A–10C show different views of the microfabricated array of cylindrical ion traps.
Figure 10B:
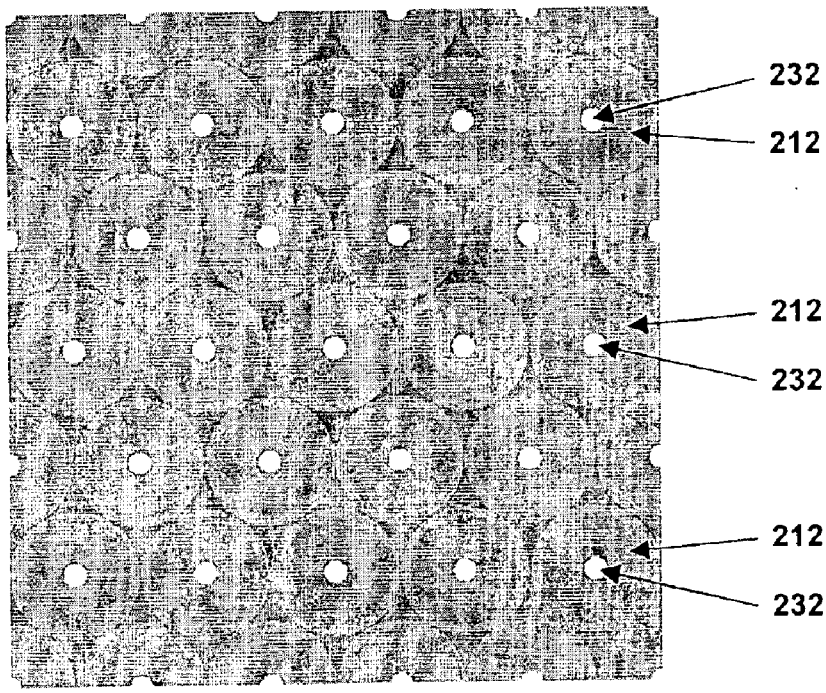
Figure 10C:
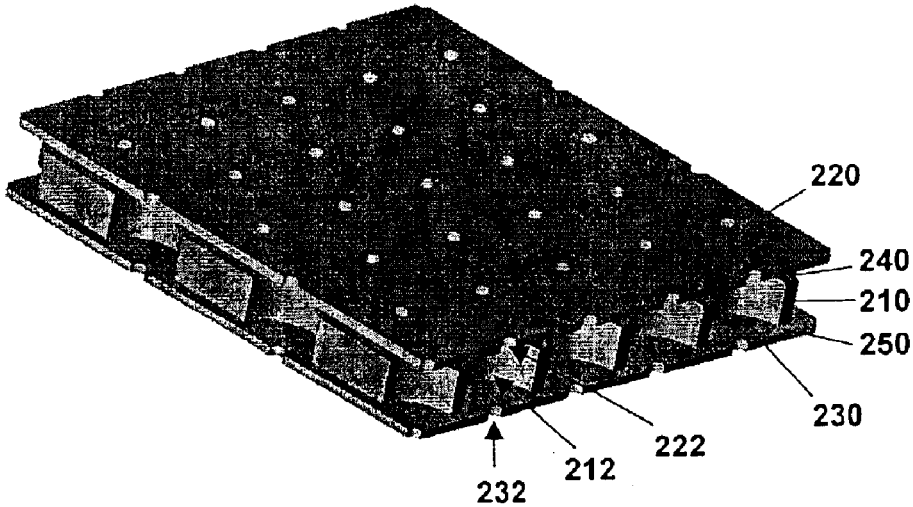

FIGS. 10A, 10B, and 10C show different views of the microfabricated array 200 without the ion collector substrate 270. FIG. 10A is a side view, showing the extraction endcap electrode layer 230, the extraction endcap dielectric layer 250, the ring electrode layer 210, the injection endcap dielectric layer 240, and the injection endcap electrode layer 220. FIG. 10B is a top view of the microfabricated array with the injection endcap electrode layer removed, showing a HCP array of cylindrical holes 212 with an extraction aperture 232 substantially on the cylindrical axis of each of the cylindrical holes 212. FIG. 10C is a perspective view, showing the extraction endcap electrode layer 230, comprising the array of extraction apertures 232; the extraction endcap dielectric layer 250; the ring electrode layer 210, comprising the array of cylindrical holes 212; the injection endcap dielectric layer 240; and the injection endcap electrode layer 220, comprising the array of injection apertures 222.

In another embodiment, the extraction electrode and collector dielectric layers can be eliminated and the CIT array can simply comprise a conducting substrate that itself provides an endcap electrode; the dielectric layer 250 on the conducting substrate; the ring electrode layer 210, comprising the array of cylindrical holes 212, on the dielectric layer 250; the injection endcap dielectric layer 240 on the ring electrode layer 210; and the injection endcap electrode layer 220, comprising the array of injection apertures 222, on the injection endcap dielectric layer 240. The conducting substrate can preferably be a conducting layer on an insulating substrate, as described above. This simple CIT array may be preferable for ion storage applications. Furthermore, since ions can both be injected and ejected through the injection apertures 222, an ion detector(s) can be placed on the injection-side of the CIT array. Ion detection may also be possible by measuring the weak image currents induced by the orbiting trapped ions in the conducting substrate.

Externally generated ions can be injected through the injection apertures 222 in the injection endcap electrode layer 220. Alternatively, ions can be formed internally by ionizing a neutral sample gas in the trapping volume 212 with ionizing radiation from an external ionizing source. For example, a neutral sample gas can be ionized by electron-impact ionization by injecting electrons from an external electron source through the injection aperture 222 into the trapping volume. Since the trapping well depth of the microscale CIT is shallow (i.e., $D_z \sim D_{min}$), internal ionization of the sample gas is preferred. See Kornienko et al., *Rev. Sci. Instrum.* 70(10), 3907 (1999) and Orient et al., *Rev. Sci. Instrum.* 73(5), 2157 (2002), which are incorporated herein by reference.

The array 200 further comprises a power supply 290 to apply voltages to the electrode layers 210, 220, and 230. A rf drive voltage $V_{ring}$ is applied between the ring electrode layer 210 and the endcap electrode layers 220 and 230. A dc or rf voltage $V_{endcap}$ can be applied between the two endcap electrode layers 220 and 230. Mass analysis can typically be performed by stepping or ramping the applied rf drive voltage to cause ions of increasing m/z to become unstable in the Z-direction and be ejected from the trapping volume 212 through the extraction aperture 232. Ions can also be ejected from by application of a dc pulse to an endcap electrode layer 220 or 230. Alternatively, the ring voltage $V_{ring}$ can further comprise a dc voltage in addition to the rf drive voltage to isolate stable ions. Various methods of ion isolation that can be used with the present invention including apex isolation, stored-waveform inverse Fourier transform (SWIFT), filtered noise field (FNF), and selected ion storage. See Guan et al., *Int. J. Mass Spectrom. And Ion Processes* 157/158, 5 (1996); Kenny et al., *Rapid Commun. Mass Spectrom.* 7, 1086 (1993); and Wells et al., *Anal. Chem.* 67, 3650 (1995), which are incorporated herein by reference. The ejected ions can be collected by the ion collector 270. The collected ion charge can be measured by detector electronics (not shown) and analyzed by suitable signal processing methods.

A parasitic capacitance exists in the CIT array 200 due to the direct overlap between the endcap electrodes 220 and 230 and the ring electrode 210. This overlap capacitance will cause a power loss. The geometric overlap for a single trap 100 in a HCP array is $$A_{ovlp,trap}=A_{cell}-A_{cylinder}=(4r_0^2+4sr_0+s^2)\sin 60°-\pi r_0^2 \quad (8)$$

where $A_{cell}$ is the area of an HCP cell and $A_{cylinder}$ is the cross-sectional area of the cylindrical hole 212. Therefore, the power loss for the array 200 due to the overlap capacitance from both the injection and extraction ends of each trap 100 is $$P_{loss}=CV_{ring}^2\Omega=\frac{1.113\times 10^8 V_{ring}^2 f}{d}\left[1-\frac{\pi r_0^2}{(4r_0^2+4sr_0+s^2)\sin 60°}\right] \quad (9)$$

where d is the space between the endcap electrodes and the ring electrode (i.e., the thickness of the endcap dielectric layers) and $\in_0$ is the effective dielectric constant of the interelectrode material. The power loss due to the overlap capacitance can become large at high drive frequencies. For an array with $r_0$=1 μm, s=0.5 μm, d=0.2 μm, $V_{ring}$=2.5 volts, and f=82 MHz, the power loss is $P_{loss}$=12 watts. This power loss is acceptable for most applications. The power loss can be reduced by increasing the dielectric spacing or reducing the overlap area.

One or more cylindrical ion traps can be fabricated on a substrate by surface micromachining techniques generally known to the IC manufacturing and MEMS industries. In particular, the microscale CIT array can be fabricated similarly to a silicon IC metallization (i.e., interconnection) scheme. Such methods enable batch fabrication and integration of the microscale CITs with on-chip electronic circuitry.

In FIGS. 11A–11H are shown cross-sectional views of a method to fabricate the parallel array of CITs on a common substrate, according to the embodiment shown in FIG. 9. The method comprises sequentially depositing the dielectric isolation layer 274, ion collector layer 272, collector dielectric layer 260, extraction endcap electrode layer 230, extraction endcap dielectric layer 250, and ring electrode layer 210 on the substrate 276; patterning the ring electrode layer 210 to form the array of cylindrical holes 212; overfilling the patterned ring electrode layer 210 with the injection endcap dielectric layer material; planarizing the overfilled material to leave the injection endcap dielectric layer on the patterned ring electrode layer; depositing the injection endcap electrode layer 220 on the planarized dielectric layer; patterning injection apertures 222 in the injection endcap electrode layer 220; removing the intraelectrode material to leave dielectric spacers in the endcap dielectric layers 240 and 250; and patterning extraction apertures 232 in the extraction endcap electrode layer 230 and the collector dielectric layer 260. Definition of the interconnections for the various conducting electrodes can be performed during the patterning of the various conducting electrode layers 210, 220, and 230 or in a sequence of patterning steps.

Figure 11A:
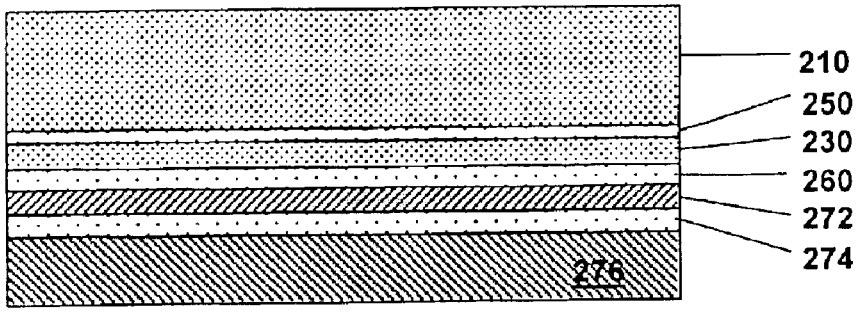
FIGS. 11A–11H show cross-sectional views of a method to fabricate a parallel array of microscale cylindrical ion traps oh a common substrate.

In FIG. 11A, a substrate 276 is provided on which the multi-layer structure of the CIT array 200 can be fabricated. The substrate 276 can comprise an insulating, semiconducting or conducting material. The substrate 276 is preferably a single crystal silicon wafer. A dielectric isolation layer 274 can be deposited on the substrate 276 to provide for electrical isolation of the ion collector layer 272 from the substrate 276. Preferably, the dielectric isolation layer 274 comprises silicon dioxide or silicon nitride (e.g., 1 μm thickness) deposited by plasma enhanced chemical vapor deposition (PECVD). The ion collector layer 272 can be an electrically conducting or doped semiconducting, material deposited on the dielectric isolation layer 274 to collect the ions ejected from the array of ion traps. Preferably, the ion collector layer 272 can be a 0.3–0.5 μm thickness of doped-silicon, aluminum, or tungsten. The collector dielectric layer 260 can be deposited on the ion collector layer 272 to provide for electrical isolation of the extraction endcap electrode layer 230 from the ion collector layer 272. Preferably, the collector dielectric layer 260 can be a 0.25–0.5 μm thickness of PECVD silicon dioxide or silicon nitride.

The extraction endcap electrode layer 230 can be deposited on the collector dielectric layer 260. The extraction endcap electrode material is preferably a good electrical conductor. The extraction endcap electrode layer 230 can be a 0.3–0.5 $\mu$m thickness of evaporated aluminum or copper, CVD tungsten, or LPCVD in-situ doped silicon. The extraction endcap dielectric layer 250 can be deposited on the extraction endcap electrode layer 230. The extraction endcap dielectric layer 250 preferably can be a 0.2–0.5 $\mu$m thickness of PECVD silicon dioxide or silicon nitride. The ring electrode layer 210 can be deposited on the extraction endcap dielectric layer 250. The thickness of the ring electrode layer 212 can be twice the center-to-endcap distance of the cylindrical ion trap 100, minus the thickness of the endcap dielectric layers 240 and 260 (i.e., $2z_0-2d$). Therefore, for $z_0=0.7$ $\mu$m and $d=0.2$ $\mu$m, the ring electrode layer 210 can have a thickness of 1 $\mu$m. The ring electrode material is preferably a good electrical conductor with a small rf skin depth, such as aluminum, copper, tungsten, titanium nitride, nickel, chromium, or other interconnect metal.

Figure 11B:
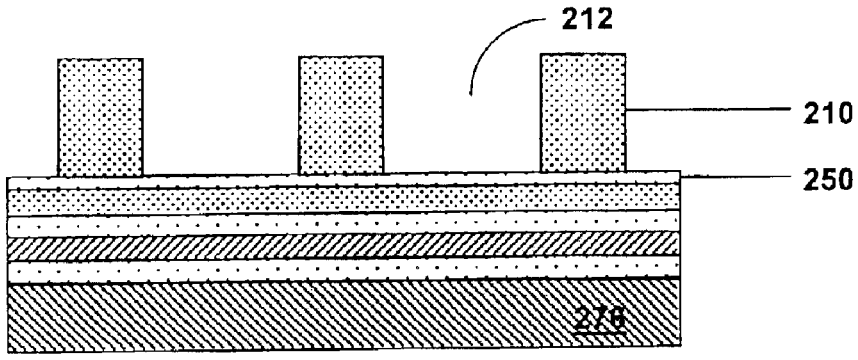

In FIG. 11B, the ring electrode layer 210 can be patterned to provide the array of cylindrical holes 212, each hole defining the trapping volume of an ion trap 100. Preferably, the pattern comprises an HCP array of hollow cylinders having a radius of $r_0$ with a center-to-center spacing of $(2r_0+s)$. For an HCP array with $r_0=1$ $\mu$m and $s=0.5$ $\mu$m, the center-to-center spacing can be 2.5 $\mu$m.

Figure 11C:
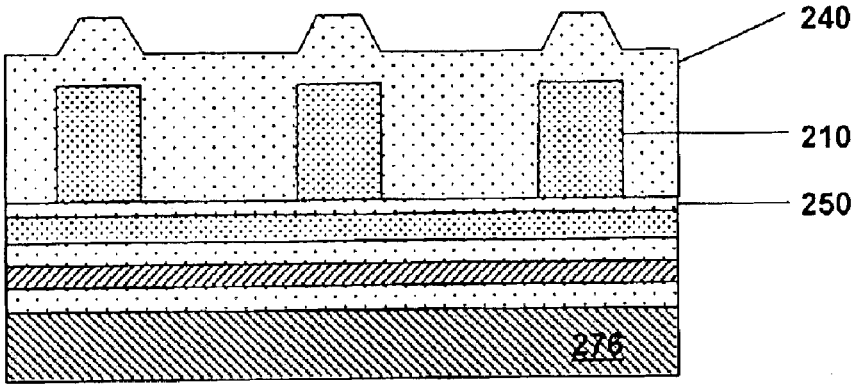

In FIG. 11C, the patterned electrode layer 210 can be overfilled with injection endcap dielectric material. The overfilled injection endcap dielectric material can preferably be a thick layer of PECVD silicon dioxide (e.g., 1.5 $\mu$m thickness). Overfilling with the injection endcap dielectric material will result in a rough and uneven growth surface due to the topology of the underlying patterned ring electrode layer 210.

Figure 11D:
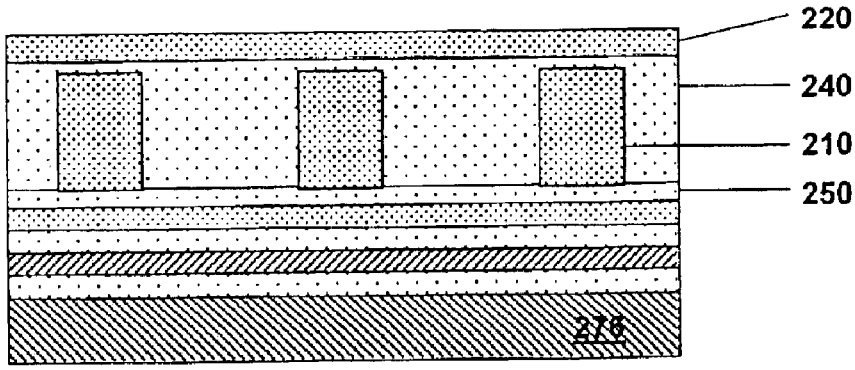

In FIG. 11D, the top surface of the overfilled injection endcap dielectric material can be planarized by chemical mechanical polishing (CMP) to provide a suitable dielectric spacer above the top surface of the patterned ring electrode layer 210. The planarized injection endcap dielectric layer 240 can have a thickness of 0.2–0.5 $\mu$m above the top surface of the patterned ring electrode layer 210. The injection endcap electrode layer 220 can then be deposited on the planarized injection endcap dielectric layer 240. The injection endcap electrode layer 220 preferably can be 0.3–0.5 $\mu$m thickness of aluminum, copper, tungsten, or other interconnect metal.

Figure 11E:
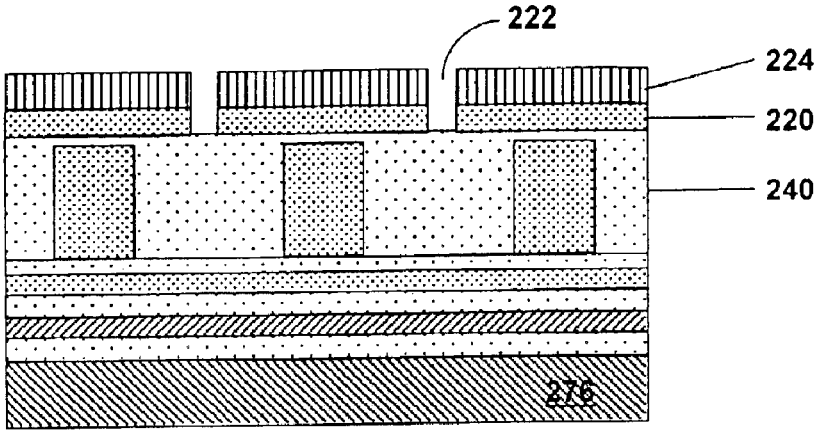

In FIG. 11E, a photoresist layer 224 can be deposited on the injection endcap electrode layer 220. The photoresist layer 224 can be lithography exposed and developed to provide openings for the patterning of the array of injection apertures 222 in the injection endcap electrode layer 220. The exposed material of the injection endcap electrode layer 220 can be removed by etching (e.g., with a chlorine-based etchant for aluminum or a fluorine-based etchant for tungsten) to provide the injection apertures 222. The etch will effectively stop when it reaches the highly selective silicon dioxide of the injection endcap dielectric layer 240. Each injection aperture 222 is preferably on or near the cylindrical axis of each cylindrical hole 212. The size of the injection apertures 222 can be chosen small enough to not substantially perturb the trapping field or as large as the cylindrical hole 212 in the ring electrode layer 210. Each injection aperture 222 can preferably have a hole radius of 0.2 $\mu$m.

Figure 11F:
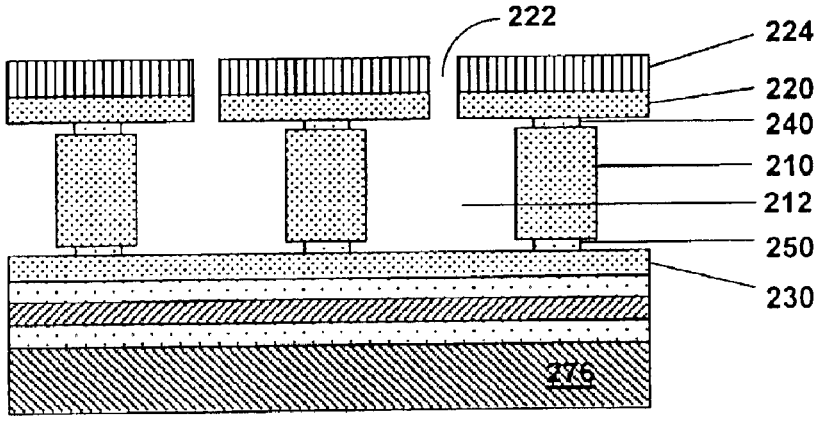

In FIG. 11F, the injection endcap dielectric layer 240 can be etched to remove the intraelectrode dielectric material filling the holes 212 of the patterned ring electrode layer 210. The etching time can be controlled to leave some dielectric spacer material in the endcap dielectric layers 240 and 250 between the ring electrode layer 210 and the endcap electrode layers 220 and 230. For example, silicon dioxide dielectric material can be etched by wet chemical etchant with selectivity to aluminum or tungsten electrode material.

Figure 11G:
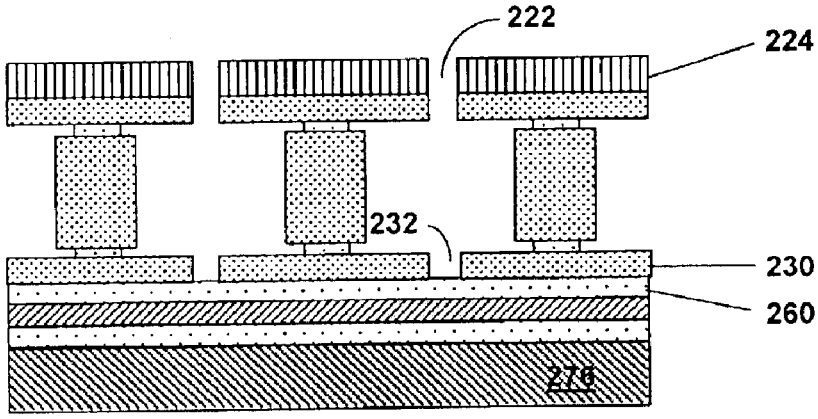

In FIG. 11G, the array of extraction apertures 232 can be patterned in the extraction endcap electrode layer 260 by self-aligned dry etching through the injection apertures 222 in the injection endcap electrode layer 220. By self-aligned etching, the location and size of the extraction apertures 232 will be the same as the injection apertures 222. Therefore, each extraction aperture 232 is preferably on or near the cylindrical axis of each cylindrical hole 212, since unstable ions will be ejected along the cylindrical axis of each CIT 100.

Figure 11H:
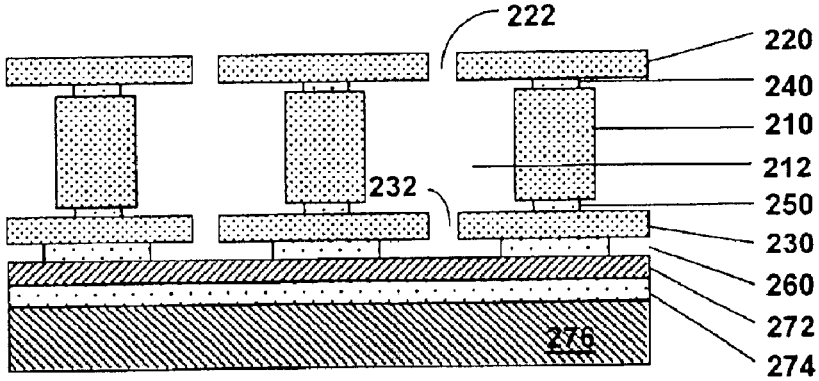

In FIG. 11H, holes in the collector dielectric layer 260 can be opened by etching through the extraction apertures 232 in the extraction endcap electrode layer 230. The photoresist layer 224 can then be stripped by standard solvents or dry/plasma etching means to provide the array 200 of CITs 100, comprising the ring electrode layer 210 having an array of cylindrical holes 212 therein, planar endcap electrode layers 220 and 230 having an array of apertures 222 and 232 therein, dielectric spacer layers 240 and 250, collector dielectric layer 260, ion collector layer 272, and dielectric isolation layer 274 on the substrate 276.

The present invention has been described as a microfabricated cylindrical ion trap. It will be understood that the above description is merely illustrative of the applications of the principles of the present invention, the scope of which is to be determined by the claims viewed in light of the specification. Other variants and modifications of the invention will be apparent to those of skill in the art.

I claim:

1. A microfabricated cylindrical ion trap, comprising:

a conducting substrate providing an endcap electrode;

a dielectric layer on the conducting substrate;

a ring electrode layer, having at least one cylindrical hole having an inner radius of less than ten microns formed therein to trap ions, on the dielectric layer;

an injection endcap dielectric layer on the ring electrode layer;

an injection endcap electrode layer on the injection endcap dielectric layer; and means for applying an radiofrequency drive voltage between the ring electrode layer and the substrate; and wherein the injection endcap layers have at least one injection aperture formed therethrough for injection of sample gas into the at least one cylindrical hole.

2. The microfabricated cylindrical ion trap of claim 1, wherein the dielectric layers comprise silicon dioxide or silicon nitride.

3. The microfabricated cylindrical ion trap of claim 1, wherein the electrode layers comprise a metal.

4. The microfabricated cylindrical ion trap of claim 3, wherein the metal comprises aluminum, copper, tungsten, titanium nitride, nickel, or chromium.

5. The microfabricated cylindrical ion trap of claim 1, wherein each of the at least one of the injection aperture is substantially on the cylindrical axis of each of the at least one cylindrical hole.

6. The microfabricated cylindrical ion trap of claim 1, further comprising means to ionize the sample gas in the at least one cylindrical hole.

7. The microfabricated cylindrical ion trap of claim 1, wherein the at least one cylindrical hole has an inner radius of less than about one microns.

8. The microfabricated cylindrical ion trap of claim 7, wherein the dielectric layer and the injection endcap dielectric layer each have thickness less than 0.5 microns.

9. The microfabricated cylindrical ion trap of claim 1, further comprising means for applying a radiofrequency voltage between the injection endcap electrode layer and the substrate.

10. The microfabricated cylindrical ion trap of claim 1, further comprising means for applying a direct current voltage between the injection endcap electrode layer and the substrate.

11. The microfabricated cylindrical ion trap of claim 1, further comprising means for applying a direct current voltage between the ring electrode layer and the substrate.

12. The microfabricated cylindrical ion trap of claim 1, wherein the dielectric layer and the injection endcap dielectric layer each have thickness less than 5 microns.

13. A microfabricated cylindrical ion trap, comprising:

a substantially planar conducting endcap electrode;

a dielectric layer on the endcap electrode;

a ring electrode layer, having at least one cylindrical hole having an inner radius of less than ten microns formed therein to trap ions, on the dielectric layer;

an injection endcap dielectric layer on the ring electrode layer;

an injection endcap electrode layer on the injection endcap dielectric layer; and means for applying an radiofrequency drive voltage between the ring electrode layer and the endcap electrode; and wherein the injection endcap layers have at least one injection aperture formed therethrough for injection of sample gas into the at least one cylindrical hole.

* * * * *